US005505796A

United States Patent [19]

Kawano et al.

[11] Patent Number: 5,505,796

[45] Date of Patent: Apr. 9, 1996

[54] HIGH YIELD RATIO-TYPE, HOT ROLLED HIGH STRENGTH STEEL SHEET EXCELLENT IN FORMABILITY OR IN BOTH OF FORMABILITY AND SPOT WELDABILITY, AND PRODUCTION THEREOF

[75] Inventors: Osamu Kawano; Junichi Wakita, both of Oita; Kazuyoshi Esaka, Tokai; Norio Ikenaga; Hiroshi Abe, both of Oita, all of Japan

[73] Assignee: Nippon Steel Corporation, Tokyo, Japan

[21] Appl. No.: 107,833

[22] PCT Filed: May 28, 1992

[86] PCT No.: PCT/JP92/00698

§ 371 Date: Aug. 27, 1993

§ 102(e) Date: Aug. 27, 1993

[87] PCT Pub. No.: WO92/21784

PCT Pub. Date: Dec. 10, 1992

[30] Foreign Application Priority Data

May 30, 1991 [JP] Japan ..... 3-153795
Apr. 16, 1992 [JP] Japan ..... 4-121085

[51] Int. Cl.[6] ..... C21D 8/02

[52] U.S. Cl. ..... 148/546; 148/547; 148/601; 148/602

[58] Field of Search ..... 148/546, 547, 148/601, 602

[56] References Cited

U.S. PATENT DOCUMENTS 5,017,248 5/1991 Kawano et al. ..... 420/84

FOREIGN PATENT DOCUMENTS

| | | |
|---|---|---|
| 0295500 | 12/1988 | European Pat. Off. . |
| 58-11734 | 1/1983 | Japan . |
| 60-43425 | 3/1985 | Japan . |
| 60-165320 | 8/1985 | Japan . |
| 60-184664 | 9/1985 | Japan . |
| 62-164828 | 7/1987 | Japan . |
| 62-202048 | 9/1987 | Japan . |
| 63-241120 | 10/1988 | Japan . |
| 64-79345 | 3/1989 | Japan . |
| 1-184226 | 7/1989 | Japan . |
| 1168819 | 7/1989 | Japan . |

*Primary Examiner*—Sikyin Ip
*Attorney, Agent, or Firm*—Wenderoth, Lind & Ponack

[57] ABSTRACT

A high yield ratio-type, hot rolled high strength steel sheet excellent in both formability and spot weldability, containing not less than 5% of retained austenite, and a process for producing the same are provided. The steel sheet contains 0.05 to less than 0.15% by weight or 0.15 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, no more than 0.01% by weight of S, and 0.005 to 0.10% by weight of Al, the balance essentially being Fe, and is composed of three phases of ferrite, bainite and retained austenite as a microstructure, and having a ratio ($V_F/d_F$) of ferrite volume fraction ($V_F$) to ferrite grain size ($d_F$) of not less than 20 (not less than 7 in case of 0.15 to less than 0.30% by weight of C), a volume fraction of retained austenite having grain sizes of not more than 2 μm being 5% or more, a yield ratio (YR) of not less than 60%, a strength-ductility balance (tensile strength×total elongation) of not less than 2,000 (kgf/mm$^2$.%), an enlargement ratio ($d/d_o$) of not less than 1.4 (not less than 1.1 in case of 0.15 to less than 0.30% by weight of C), and a uniform elongation of not less than 15% (not less than 10% in case of 0.15 to less than 0.30% by weight of C).

16 Claims, 6 Drawing Sheets

(P ≦ 0.02%, Si+Mn ≦ 6.0%, Si,Mn ≦ 3.0%)

① One-stage cooling ② Two-stage cooling ③ Three-stage cooling

* Preferably 5~20° C/S (including maintenance at constant temperature)

(quenching right after finish-rolling is applicable to any of cooling procedures)

HIGH YIELD RATIO-TYPE, HOT ROLLED HIGH STRENGTH STEEL SHEET EXCELLENT IN FORMABILITY OR IN BOTH OF FORMABILITY AND SPOT WELDABILITY, AND PRODUCTION THEREOF

TITLE OF THE INVENTION

High yield ratio-type, hot rolled high strength steel sheet excellent in formability or in both formability and spot weldability, and production thereof.

TECHNICAL FIELD

The present invention relates to a hot rolled high strength steel sheet (plate) with a high ductility and an excellent formability or excellent formability and spot weldability, directed to use in automobiles, industrial machines, etc. and to a process for producing the same.

BACKGROUND ART

Prior Art

Due to keen demands for lighter weight of automobile steel sheets and safety assurance at collisions of automobiles as main backgrounds, higher strength is required for steel sheets. However, workability is required even for the high strength steel sheets, and steel sheets capable of satisfying the requirements for both strength and workability are in keen demand. Heretofore, dual phase steel (which will be hereinafter referred to as "DP steel") comprising ferrite and martensite has been proposed for hot rolled steel sheets for use in the field that has required a good ductility. It is known that DP steel has a better strength-ductility balance than those of solid solution-intensified, high strength steel sheets and precipitation-intensified, high strength steel sheets, but its strength-ductility balance limit is at TS×T.E1≦2,000. That is, DP steel fails to meet more strict requirements in the current situations.

As means capable of meeting the requirements in the current situations to attain TS×T.E1>2,000, it has been proposed to utilize retained austenite. For example, Japanese Patent Application Kokai (Laid-open) No. 60-43425 discloses a process for producing a steel sheet containing retained austenite, which comprises hot rolling a steel sheet in a temperature range of $Ar_3$ to $Ar_3$+50° C., retaining the steel sheet in a temperature range of 450° to 650° C. for 4 to 20 seconds and coiling it at a temperature of not more than 350° C., and also Japanese Patent Application Kokai (Laid-open) No. 60- 165320 discloses a process for producing a steel sheet containing retained austenite, which comprises conducting high reduction rolling of a steel sheet at a finishing temperature of not less than 850° C., at an entire draft of at least 80%, a total draft of at least 60% for final three passes and a draft of at least 20% for the ultimate pass, and then conducting cooling to 300° C. or less at a cooling speed of at least 50 ° C./s.

However, these conventional processes are not preferable in practice from the viewpoints of energy saving and productivity improvement, because of retention at 450° to 650° C. for 4 to 20 seconds during the cooling, coiling at a low temperature such as 350° C. or less, high reduction rolling, etc. Furthermore, the workability of the steel sheets produced by these processes is at TS×T.E1<2,400, which would not always have fully satisfied the level required by users. That is, steel sheets having a higher TS×T.E1 (desirably more than 2,400) and a high productivity process for producing such steel sheets have still been in demand. On the other hand, in view of the actual formability, not only a good strength-ductility balance, but excellent uniform elongability (stretchability), enlargeability or hole expansibility (enlargeability into a flange shape), bendability, secondary workability, and toughness are also required. Furthermore, in the service field of these steel sheets, spot welding is more and more used, and thus an excellent spot weldability is also required. Still further, not only a higher tensile strength, but also a higher yield ratio (higher yield strength) is required from the viewpoint of strength assurance.

That is, the field of actual application can be considerably broadened by satisfying these requirements at the same time.

(Problems to be solved by the invention)

The present invention provides a hot rolled, high strength steel sheet having an excellent workability, containing retained austenite and being capable of attaining TX×T.E1≧2,000, which is over the limit of the prior art, and also a process for producing the same. Furthermore, the present invention provides a hot rolled, high strength steel sheet having an excellent formability (strength-ductility balance, uniform elongability, enlargeability, bendability, secondary workability and toughness), a high yield ratio and an excellent spot weldability at the same time and also a process for producing the same.

DISCLOSURE OF INVENTION

To solve the above-mentioned problems, the present invention uses the following means (1) to (20):

(1) A high yield ratio-type, hot rolled high strength steel sheet excellent in both formability and spot weldability, characterized by comprising 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, a volume fraction of retained austenite having a grain size of not more than 2 μm being not less than 5%, and a yield ratio (YR) of not less than 60%, a strength-ductility balance (tensile strength×total elongation) of not less than 2,000 (kgf/mm $^2$.%), an enlargement ratio ($d/d_o$) of not less than 1.4, and a uniform elongation of not less than 15% as characteristics.

(2) A high yield ratio-type, hot rolled high strength steel sheet excellent in both formability and spot weldability, characterized by comprising 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical components, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, a volume fraction of retained austenite having a grain size of not more than 2 μm being not less than 5%, and a yield (kgf/mm$^2$.%), an enlargement ratio ($d/d_o$) of not less than 1.4, ratio (YR) of not less than 60%, a strength-ductility balance (tensile strength×total elongation) of not less than 2,000 and a uniform elongation of not less than 15% as characteristics.

(3) A process for producing a high yield ratio-type, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, characterized by conducting a finish-rolling of a slab prepared by casting a steel comprising 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, in an end temperature range of $Ar_3$±50° C. at an entire draft of not less than 80% and an ultimate pass strain speed of not less than 30/second, conducting cooling at a hot run table at a rate of not less than 30° C./second, and conducting coiling at a temperature of more than 350° C. to 500° C.

(4) A process for producing a high yield ratio-type, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, characterized by conducting a finish-rolling of a slab prepared by casting a steel containing 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical components, in an end temperature range of $Ar_3$±50° C., at an entire draft of not less than 80% and an ultimate pass strain speed of not less than 30/second, conducting cooling at a hot run table at a rate of not less than 30° C./second, and conducting coiling at a temperature of more than 350° C. to 500° C.

(5) A process for producing a high yield ratio-type, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, characterized by conducting a finish-rolling of a slab prepared by casting a steel comprising 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of less than 30° C./second, and from $T_1$ downwards at a rate of not less than 30° C./second, and conducting coiling at a temperature of more than 350° C. to 500 ° C.

(6) A process for producing a high yield ratio-type, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%) an enlargement ratio ($d/d_o$) of not less than 1.4 and a uniform elongation of not less than 15%, characterized by conducting a finish-rolling of a slab prepared by casting a steel comprising 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical components, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$, at a rate of less than 30° C./second, and from $T_1$ downwards at a rate of not less than 30° C./second, and conducting coiling at a temperature of more than 350° C. to 500° C.

(7) A process for producing a high yield ratio-type, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, characterized by conducting a finish-rolling of a slab prepared by casting a steel comprising 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of not less than 30° C./second, and from $T_1$ downwards to a temperature $T_2$ in a range of not more than $T_1$ to more than $Ar_1$ at a rate of less than 30° C./second, and furthermore from $T_2$ downwards at a rate of not less than 30° C./second, and conducting coiling at a temperature of more than 350° C. to 500° C.

(8) A process for producing a high yield ratio-type, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, characterized by conducting a finish-rolling of a slab prepared by casting a steel comprising 0.05 to less than 0.16% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical components, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of not less than 30 ° C./second, and from $T_1$ downwards to a temperature $T_2$ in a range of not more than $T_1$ to more than $Ar_1$ at a rate of less than 30° C./second, and furthermore from a $T_2$ and downwards at a rate of not less than 30° C./second, and conducting coiling at a temperature of more than 350° C. to 500° C.

(9) A high yield ratio-type, hot rolled high strength steel sheet excellent in formability, characterized by comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, being composed of three phases of ferrite, bainite, and retained austenite as microstructures, and having a ferrite grain size ($d_F$) of not more than 5 μm, a ratio ($V_F/d_F$) of ferrite volume fraction ($V_F$) to ferrite grain size ($d_F$) of not less than 7, a volume fraction of retained austenite having a grain size of not more than 2 μm being not less than 5%, and a yield ratio (YR) of not less than 60%, a strength-ductility balance (tensile strength× total elongation) of not less than 2,000 (kgf/mm$^2$.%), an enlargement ratio ($d/d_o$) of not less than 1.1, and a uniform elongation of not less than 10% as characteristics.

(10) A high yield ratio-type, hot rolled high strength steel sheet excellent in formability, characterized by comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical components, being composed of three phases of ferrite, bainite, and retained austenite as microstructures, and having a ferrite grain size ($d_F$) of not more than 5 μm, a ratio ($V_F/d_F$) of ferrite volume fraction ($V_F$) to ferrite grain size ($d_F$) of not less than 7, a volume fraction of retained austenite having a grain size of not more than 2 μm being not less than 5%, and a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10% as characteristics.

(11) A process for producing a high yield ratio-type, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, characterized by conducting a finish-rolling of a slab prepared by casting a steel comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, in an end temperature range of $Ar_3$±50° C. at an entire draft of not less than 80% and an ultimate pass strain speed of not less than 30/second, conducting cooling at a hot run table at a rate of not less than 30° C./second, and conducting coiling at a temperature of more than 350° C. to 500° C.

(12) A process for producing a high yield ratio-type, hot rolled high strength steel sheet having an excellent formability and also a yield ratio (YR) of not less than 60%, ratio ($d/d_o$) of not less than 1.1, and a uniform elongation a strength-ductility balance (tensile strength×total elongation) of not less than 2,000 (kgf/mm$^2$.%), an enlargement of not less than 10%, characterized by conducting a finish-rolling of a slab prepared by casting a steel comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical components, at an end temperature range of $Ar_3$±50° C. at an entire draft of not less than 80% and an ultimate pass strain speed of not less than 30/second, conducting cooling at a hot run table at a rate of not less than 30° C./second, and conducting coiling at a temperature of more than 350° C. to 500° C.

(13) A process for producing a high yield ratio-type, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, characterized by conducting a finish-rolling of a slab prepared by casting a steel comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, at an end temperature of not less than $Ar_3$–50 ° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of less than 30° C./second, and from $T_1$ downwards at a rate of not less than 30° C./second, and conducting coiling at a temperature of more than 350° C. to 500° C.

(14) A process for producing a high yield ratio-type, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, characterized by conducting a finish-rolling of a slab prepared by casting a steel comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical components, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$, at a rate of less than 30° C./second and from $T_1$ downwards at a rate of not less than 30° C./second, and conducting coiling at a temperature of more than 350° C. to 500° C.

(15) A process for producing a high yield ratio-type, hot rolled high strength steel sheet having an excellent formability and also a yield ratio (YR) of not less than 60%, ratio ($d/d_o$) of not less than 1.1, and a uniform elongation a strength-ductility balance (tensile strength×total elongation) of not less than 2,000 (kgf/mm$^2$.%), an enlargement of not less than 10%, characterized by conducting a finish-rolling of a slab prepared by casting a steel comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, as chemical components, at an end temperature of not less than $Ar_3$–50 ° C. at an entire draft of not less than 80%, and an ultimate pass strain speed of not less than 30/second, conducting cooling at a hot run table down to a temperature $T_1$ in a range of not more than $Ar_3$ to more than $Ar_1$ at a rate of not less than 30° C./second, from $T_1$ downwards to a temperature $T_2$ in a range of not more than $T_1$ to more than $Ar_1$ at a rate of less than 30° C./second, and furthermore from $T_2$ downwards at a rate of not less than 30° C./second, and conducting coiling at a temperature of more than 350° C. to 500° C.

(16) A process for producing a high yield ratio-type, hot rolled high strength steel sheet having an excellent formability and also a yield ratio (YR) of not less than 60%, ratio ($d/d_o$) of not less than 1.1, and a uniform elongation a strength-ductility balance (tensile strength×total elongation) of not less than 2,000 (kgf/mm$^2$.%), an enlargement of not less than 10%, characterized by conducting a finish-rolling of a slab prepared by casting a steel comprising 0.16 to less than 0.30% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, as chemical elements, at an end temperature of not less than $Ar_3$–50° C. at an entire draft of not less than 80%, and an ultimate pass strain speed of not less than 30/second, conducting cooling at a hot run table down to a temperature $T_1$ in a range of not more than $Ar_3$ to more than $Ar_1$ at a rate of not less than 30° C./second, from $T_1$ downwards to a temperature $T_2$ in a range of not more than $T_1$ to more than $Ar_1$ at a rate of less than 30° C./second, and furthermore from $T_2$ downwards at a rate of not less than 30° C./second, and conducting coiling at a temperature of more than 350° C. to 500° C.

(17) A process for producing a high yield ratio-type, hot rolled high strength steel sheet excellent in both formability and spot weldability according to any one of the above mentioned items (3) to (8), characterized in that the hot finish-rolling initiation temperature of the steel is not more than $Ar_3$+100° C.

(18) A process for producing a high yield ratio-type, hot rolled high strength steel sheet excellent in both formability and spot weldability according to any one of the above mentioned items (3) to (8), characterized in that after the coiling the steel sheet is cooled to 200° C. or less at a cooling speed of not less than 30° C./hour.

(19) A process for producing a high yield ratio-type, hot rolled high strength steel excellent in formability according to any one of the above mentioned items (11) to (16), characterized in that the hot finish-rolling initiation temperature of the steel is not more than $Ar_3$+ 100° C.

(20) A process for producing a high yield ratio-type, hot rolled high strength steel sheet excellent in formability according to any one of the above mentioned items (11) to (16), characterized in that after the coiling the steel sheet is cooled to 200° C. or less at a cooling speed of not less than 30° C./hour.

(Function)

As a result of extensive tests and studies, the present inventors have solved the problems of the prior art and have found a hot rolled high strength steel sheet having an excellent formability, a high yield ratio and an excellent spot weldability together, and a process for producing the same.

Firstly, the microstructure of a steel sheet that can meet an excellent formability and a high yield ratio at the same time must be composed of three phases of ferrite, bainite and retained austenite, where the retained austenite has grain sizes of not more than 2 μm at a volume fraction of not less than 5%; ferrite grain size ($d_F$) is not more than 5 μm; and $V_F/d_F$ ($V_F$: ferrite volume fraction in %, $d_F$: ferrite grain size in μm) is not less than 20 (or not less than 7 when C is in a range of 0.15 to less than 0.3% by weight, because finer retained austenite grains can be readily formed).

In Table 1, their relations are shown, and their points are summarized in the following items ① to ③:

TABLE 1

| Characteristics of steel sheet | Microstructure of steel sheet: $\gamma_R$ ≦2 μm | $\gamma_R$ ≧5% | $d_F$ ≦ 5 μm | $V_F/d_F$ ≧ 20 0.05% ≦ C <0.15% | $V_F/d_F$ ≧ 7 0.15% ≦ C <0.30% | Bainite, other phase than ferrite, $\gamma_R$ |
|---|---|---|---|---|---|---|
| Strength-ductility balance | ○ | ○ | ○ | | | |
| Uniform elongation (stretchability) | ○ | ○ | ○ | | | |
| Enlargeability (enlargeability into flange shape) | ○ | | ○ | | | ○ |
| Bendability | ○ | | ○ | | | ○ |
| Secondary workability | ○ | | | ○ | ○ | ○ |
| Toughness | ○ | | ○ | ○ | ○ | ○ |
| Yield ratio (yield strength) | | | ○ | ○ | ○ | ○ |

○ shows a strong co-relation

① Increase in the retained austenite contributes to improvements of strength-ductility balance and uniform elongation, and its effect is enhanced by making the retained austenite grains finer. By making the retained austenite grains finer, the enlargeability or the hole expansibility, bendability, secondary workability and toughness can be maintained in an excellent level. That is, by making the content of retained austenite 5% or more and the grain size not more than 2 μm, an excellent strength-ductility balance, an excellent uniform elongation, an excellent enlargeability, an excellent bendability, an excellent secondary workability and an excellent toughness can be obtained at the same time.

② Increase in $V_F/d_F$ contributes to improvements of the secondary workability and toughness and an increase in the yield ratio through an increase in the ferrite volume fraction and finer ferrite grain size ($d_F \leqq 5$ μm).

③ By making the microstructure composed of three phases of ferrite, bainite and retained austenite, that is, by avoiding the inclusion of pearlite and martensite, the enlargeability, bendability, secondary workability and toughness can be maintained at an excellent level, whereby a high yield ratio can be also maintained.

Secondly, in order to contain retained austenite at a volume fraction of not less than 5%, as shown in FIGS. 1 and 2, it is necessary to control a Si content to 0.5–3.0% by weight, a Mn content to 0.5 to 3.0% by weight, and a Si+Mn content to more than 1.5 to 6.0% by weight, and make a $V_F/d_F$ ratio not less than 20, in case of 0.05 to less than 0.15% by weight of C, and to control a Si content to 0.5 to 3.0% by weight, a Mn content to 0.5 to 3.0% by weight and a Si+Mn content to more than 1.5 to 6.0% by weight and make a $V_F/d_F$ not less than 7, in case of 0.15 to less than 0.30% by weight of C. In order to make the retained austenite grain size not more than 2 μm, it is necessary to make a finish-rolling ultimate pass strain speed not less than 30/second, as shown in FIG. 3.

Thirdly, in order to obtain a best spot weldability (inside-nugget breakage=0), it is necessary that a C content is less than 0.15% by weight, a Si+Mn content is not more than 6% by weight, a Si content and a Mn content are each not more than 3.0% by weight and a P content is not more than 0.02% by weight, as shown in FIG. 4.

Fourthly, in the case that a very stringent surface property is required, it is effective to control the heating temperature to not more than 1,170° C. and a Si content to 1.0 to 2.0% by weight.

Fifthly, in order to obtain an excellent enlargeability ($d/d_o \geqq 1.4$), it is necessary to make a C content less than 0.15% by weight and a S content not more than 0.01% by weight, and it is also effective to add Ca or REM thereto, as shown in FIG. 5. In order to obtain a particularly excellent enlargeability ($d/d_o=1.5$), it is further necessary to make a C content less than 0.10% by weight.

That is, various combined characteristics required for a hot rolled high strength steel sheet can be satisfied only by strict component control and strict structure control according to the present invention.

The present inventors have made further studies of hot rolling conditions for obtaining the above-mentioned micorstructure and have found a process for producing a hot rolled high strength steel sheet.

At first, component control values and the reasons for the control will be explained below.

Not less than 0.05% by weight of C must be added to assure the retained austenite (which will be hereinafter referred to as "retained γ"). In order to prevent embrittlement at the welded parts, thereby obtaining the best spot weldability, and to obtain an excellent enlargeability ($d/d_o$) of not less than 1.4, the upper limit of C content must be less than 0.15% by weight. When the best enlargeability, $d/d_o \geqq 1.5$ is needed, the upper limit must be less than 0.10% by weight. C is also a reinforcing element, and the tensile strength will be increased with increasing C content, but $d/d_o$ will be lowered at the same time, rendering the spot weldability inevitably disadvantageous.

Si and Mn are reinforcing elements. Si also promotes formation of ferrite (which will be hereinafter referred to as "α"), thereby suppressing formation of carbides. Thus, it has an action to assure the retained γ. Mn has an action to stabilize γ to assure the retained γ. In order to fully perform the functions of Si and Mn, it is necessary to control the individual lower limits of Si and Mn and also the lower limits of Si+Mn at the same time. That is, it is necessary to control the individual lower limits of Si and Mn to not less than 0.5% by weight and the lower limit of Si+Mn to more than 1.5% by weight. Even excessive addition of Si and Mn saturates the above-mentioned effects, resulting in deterioration of weldability and slab cracking to the contrary, and thus it is necessary that the individual upper limits of Si and Mn are not more than 3.0% by weight and the upper limit of Si+Mn is not more than 6.0% by weight. When a particularly excellent surface state is required, it is desirable that a Si content is 1.0 to 2.0% by weight.

P is effective for assuring the retained γ, and in the present invention, the upper limit thereof is set to 0.02% by weight to keep the best secondary workability, toughness and weldability. When the requirements for these characteristics are not so strict, up to 0.2% by weight of P can be added to increase the retained γ.

Upper limit of S is set to 0.01% by weight to prevent deterioration of enlargeability due to the sulfide-based materials.

Not less than 0.005% by weight of Al is added for deoxidization and to increase the α volume fraction by making γ grains finer by AlN, make α grans finer, and increase the retained γ and make the retained γ grains finer, and the upper limit is set to 0.10% by weight because of saturation of the effects. Up to 3% by weight of Al may be added to promote an increase in the retained γ.

Not less than 0.0005% by weight of Ca is added to control the shape of sulfide-based materials (spheroidization), and its upper limit is set to 0.01% by weight because of saturation of the effects and adverse effect due to an increase in the sulfide-based materials (deterioration of enlargeability). For the same reason, an REM content is set to a range of 0.005 to 0.05% by weight.

The foregoing are reasons for addition of the main components. At least one of Nb, Ti, Cr, Cu, Ni, V, B, and Mo may be added in such a range as to assure the strength and make the grains finer, but not as to deteriorate the characteristics.

From the viewpoint of how to obtain the above-mentioned microstructure, values for heating control, rolling control, cooling control, coiling control, etc. and reasons for the control will be explained below.

In order to prevent deterioration of workability due to the appearance of working structure (working α), particularly the deterioration of strength-ductility balance (deterioration of elongation), the lower limit of finish-rolling end temperature is set to $Ar_3$−50° C. In case of one-stage cooling (FIG. 6). the upper limit of finish-rolling end temperature is set to $Ar_3$+50° C. to assure the effect on an increase in the α volume fraction, the effect on making the α grains finer, and the effect on an increase in the retained γ finer grains in the rolling step. In case of 2-stage cooling and 3-stage cooling (FIG. 6), as will be explained later, the effect on an increase in the α volume fraction, the effect on making the α grains finer and the effect on an increase in the retained γ finer grains can be expected in the cooling step, and thus it is not necessary to set the upper limit of finish-rolling end temperature, but the upper limit is preferably set to $Ar_3$ +50° C. to further improve the above-mentioned effects.

The entire draft of finish-rolling must be not less than 80% to assure the effect on an increase in the α volume fraction, the effect on making the α grains finer and the effect on an increase in the retained γ finer grains, and preferably the individual draft of 4 passes on the preceding stage must be not less than 40%.

The ultimate pass strain speed of finish-rolling must be not less than 30/second to assure the effect on making the α grains finer and the effect on an increase in the retained γ finer grains.

The lower limit of cooling rate of the one-stage cooling shown in FIG. 6 must be 30° C./second to prevent formation of pearlite.

In the two-stage cooling shown in FIG. 6, the first stage cooling must be carried out down to not more than $Ar_3$ at a cooling rate of less than 30° C./second to obtain the effect on an increase in the α volume fraction and the effect on an increase in the retained γ finer grains. The second stage cooling must be started from a temperature of more than $Ar_1$ at a cooling rate of not less than 30° C./second to prevent formation of pearlite. It is not objectionable to keep the temperature constant in a temperature range of not more than $Ar_3$ to more than $Ar_1$. In order to maintain a TRIP phenomenon in a wide range of the strain region and obtain excellent characteristics, it is desirable to set the first stage cooling rate to 5°–20° C./second.

In the three-stage cooling shown in FIG. 6, the first stage cooling must be carried out to not more than $Ar_3$ at a cooling rate of not less than 30° C./second to make the α grains finer. The second stage cooling is carried out at a cooling rate of less than 30° C./second to obtain the effect on an increase in the α volume fraction and the effect on an increase in the retained γ finer grains, and the third stage cooling must be started from more than $Ar_1$ at a cooling rate of not less than 30° C./second to prevent formation of pearlite. It is not objectionable to keep the temperature constant in a range of not more than $Ar_3$ to more than $Ar_1$. In order to maintain a TRIP phenomenon in a wide range of strain region and obtain excellent characteristics, it is desirable to set the second stage cooling rate to 5°–20° C./second.

In any of the one-stage cooling, two-stage cooling and three-stage cooling, quenching may be carried out just after the rolling to obtain the effect on an increase in the α volume fraction, the effect on making α grains finer and the effect on an increase in the retained γ finer grains or further to reduce the length of the cooling table.

Lower limit of coiling temperature must be more than 350° C. to prevent formation of martensite and assure the retained γ. Its upper limit must be less than 500° C. to prevent formation of pearlite, suppress excessive bainite transformation and assure the retained γ.

The foregoing are reasons for control in the present process. In order to improve the effect on an increase in the α volume fraction, the effect on making the α grains finer and the effect on an increase in the retained γ finer grains, means such as ① to set the upper limit of the heating temperature to 1,170° C., ② to set the finish-rolling initiation temperature to not more than "rolling end temperature +100° C.", etc. may be carried out alone or in combination. The upper limit of the heating temperature may be set at 1,170° C. to assure the best surface property.

Furthermore, cooling after the coiling may be spontaneous cooling or forced cooling. In order to suppress excessive bainite transformation and improve the effect on assuring the retained γ grains, cooling may be carried out down to less than 200° C. at a cooling rate of not less than 30° C./hour. Cooling may be carried out in combination with the above-mentioned heating temperature control and finish-rolling initiation temperature control.

Slabs for use in the rolling may be any of the so called reheated cold slabs, HCR and HDR, or may be slabs prepared by so called continuous steel casting.

Hot rolled steel sheets obtained according to the present invention may be used as plates for plating.

BEST MODES FOR CARRYING OUT THE INVENTION

Figure 1:
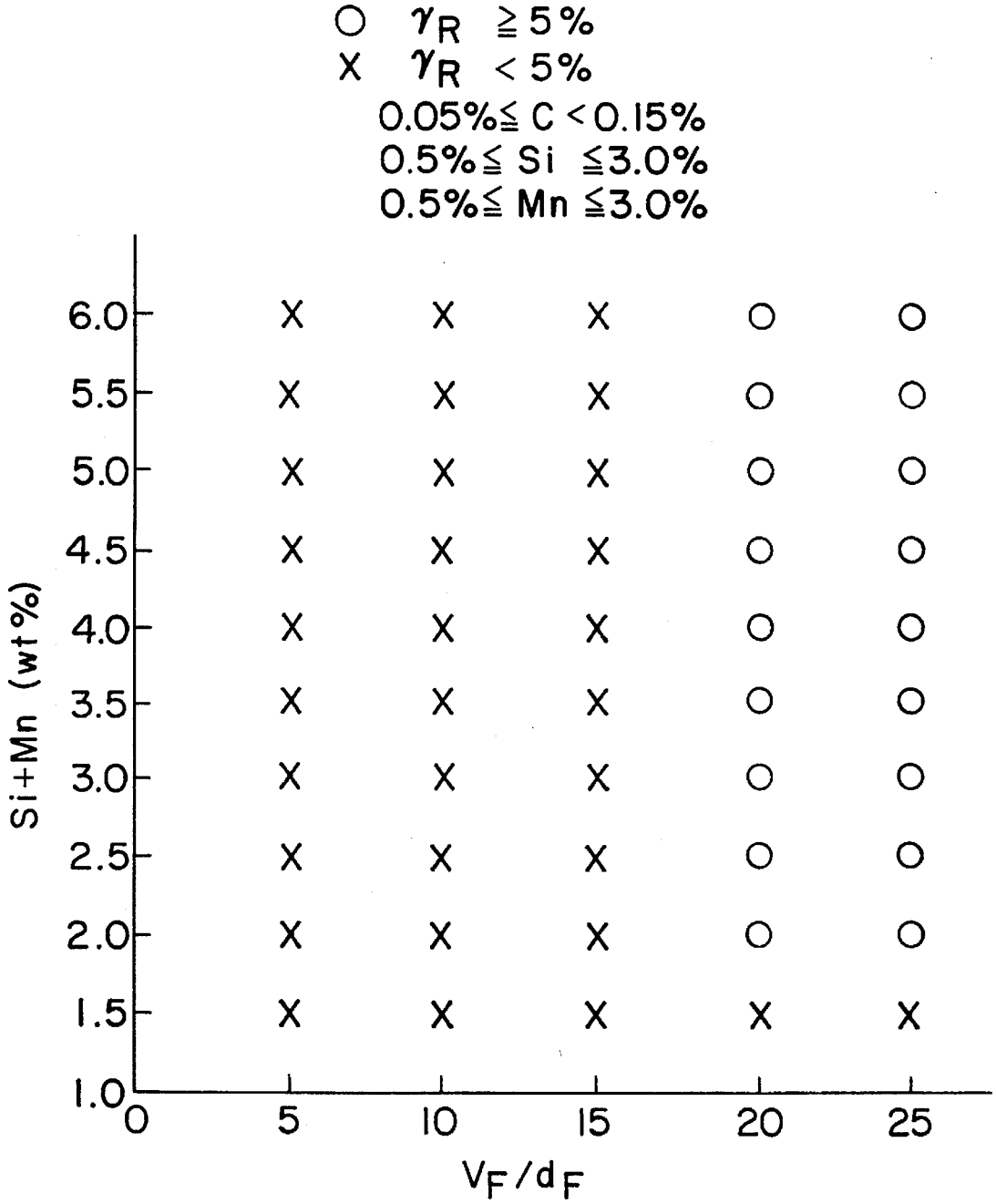
FIG. 1 is a diagram showing conditions for making retained γ not less than 5%.
Figure 2:
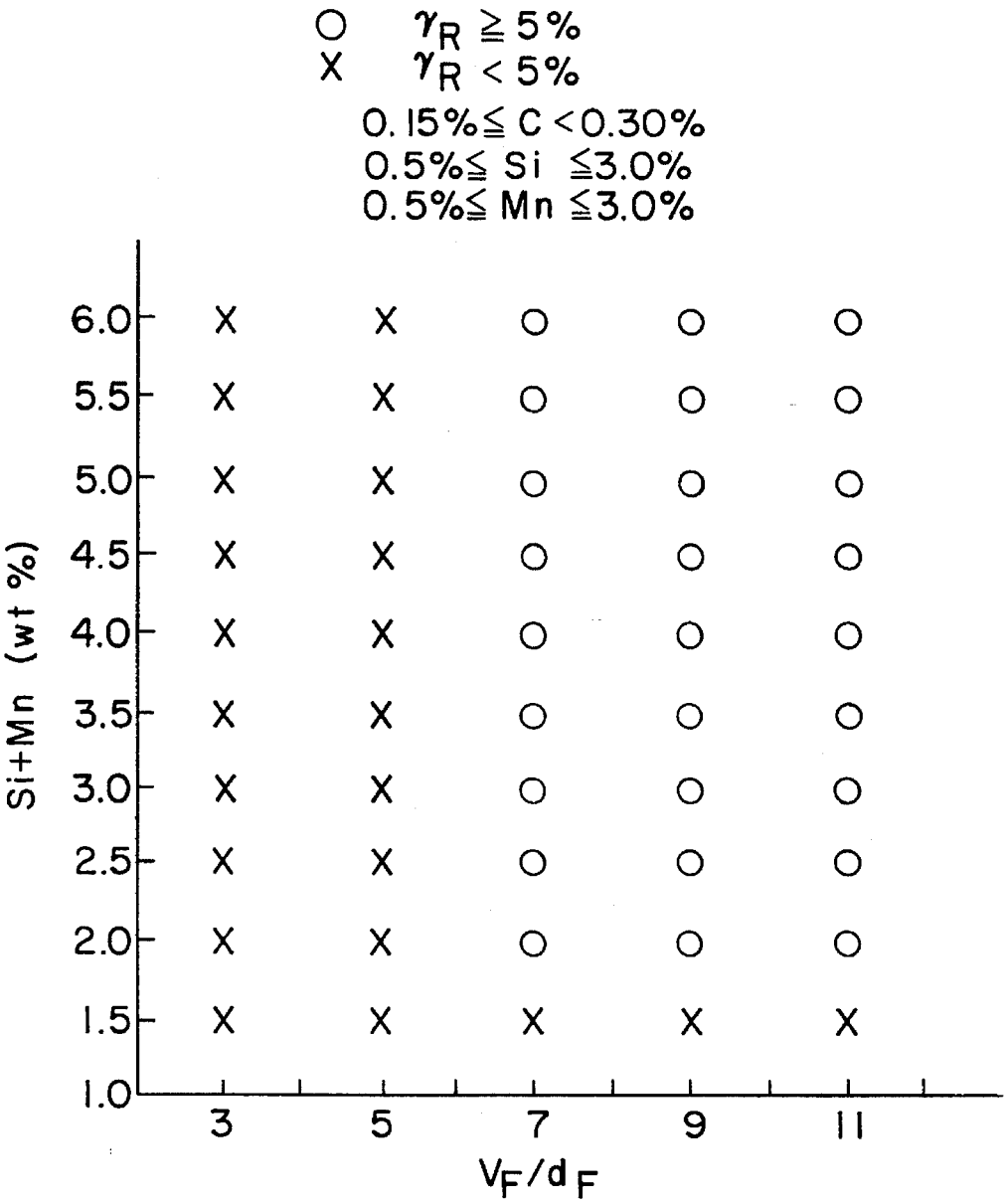
FIG. 2 is a diagram showing conditions for making retained γ not less than 5%.
Figure 3:
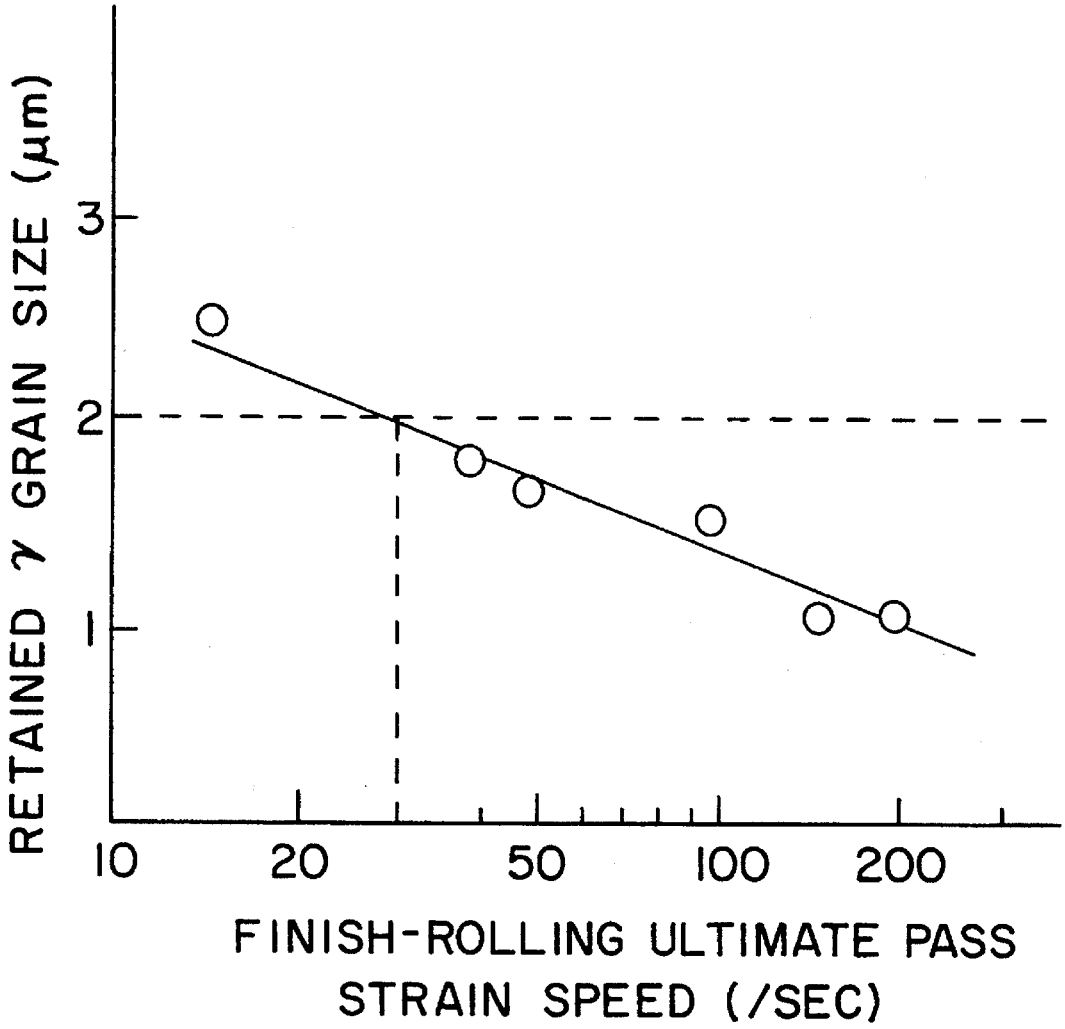
FIG. 3 is a diagram showing conditions for making retained γ grains having grain sizes of not more than 2 μm, not less than 5%.
Figure 4:
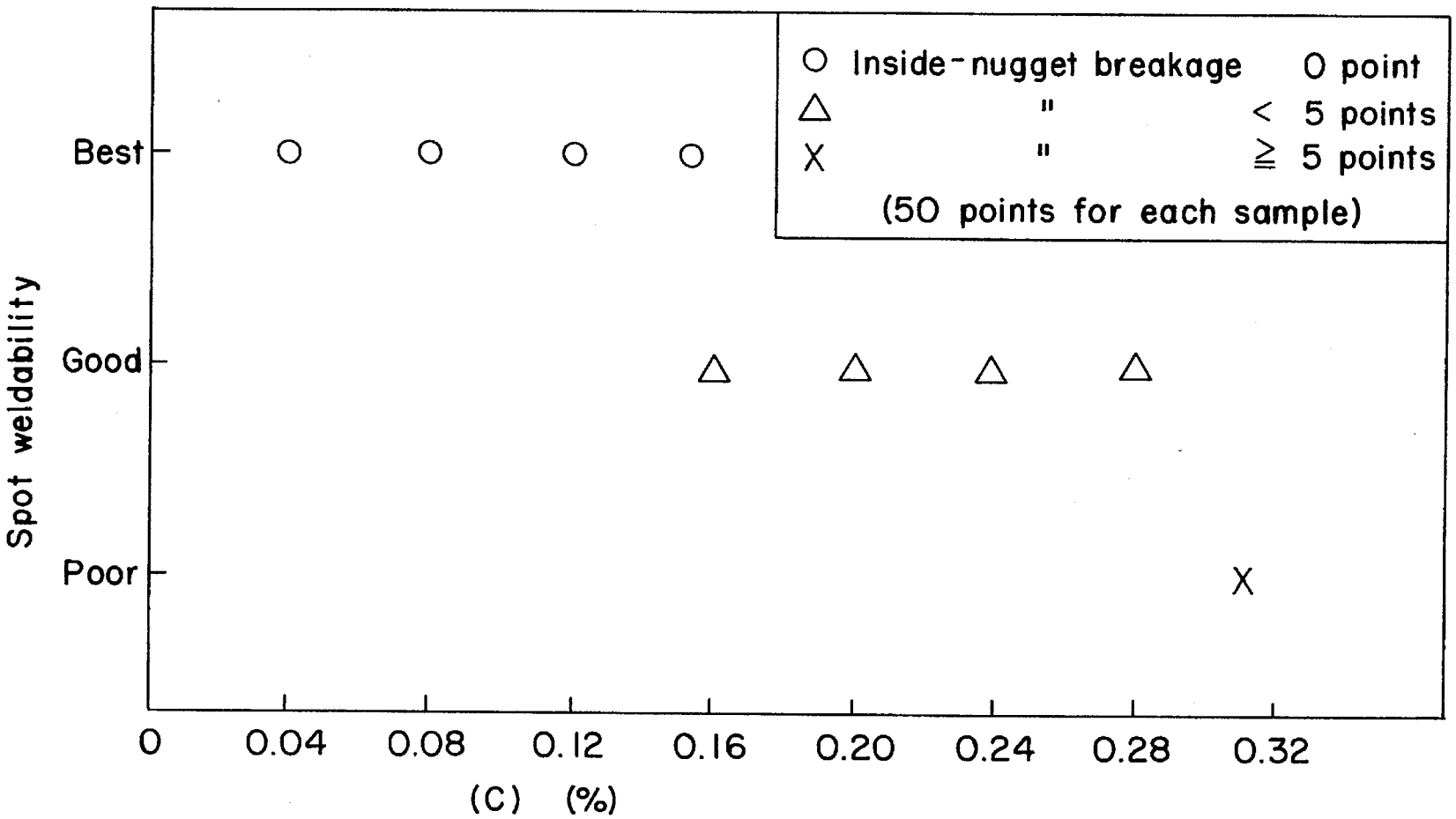
FIG. 4 is a diagram showing conditions for improving the spot weldability.
Figure 5:
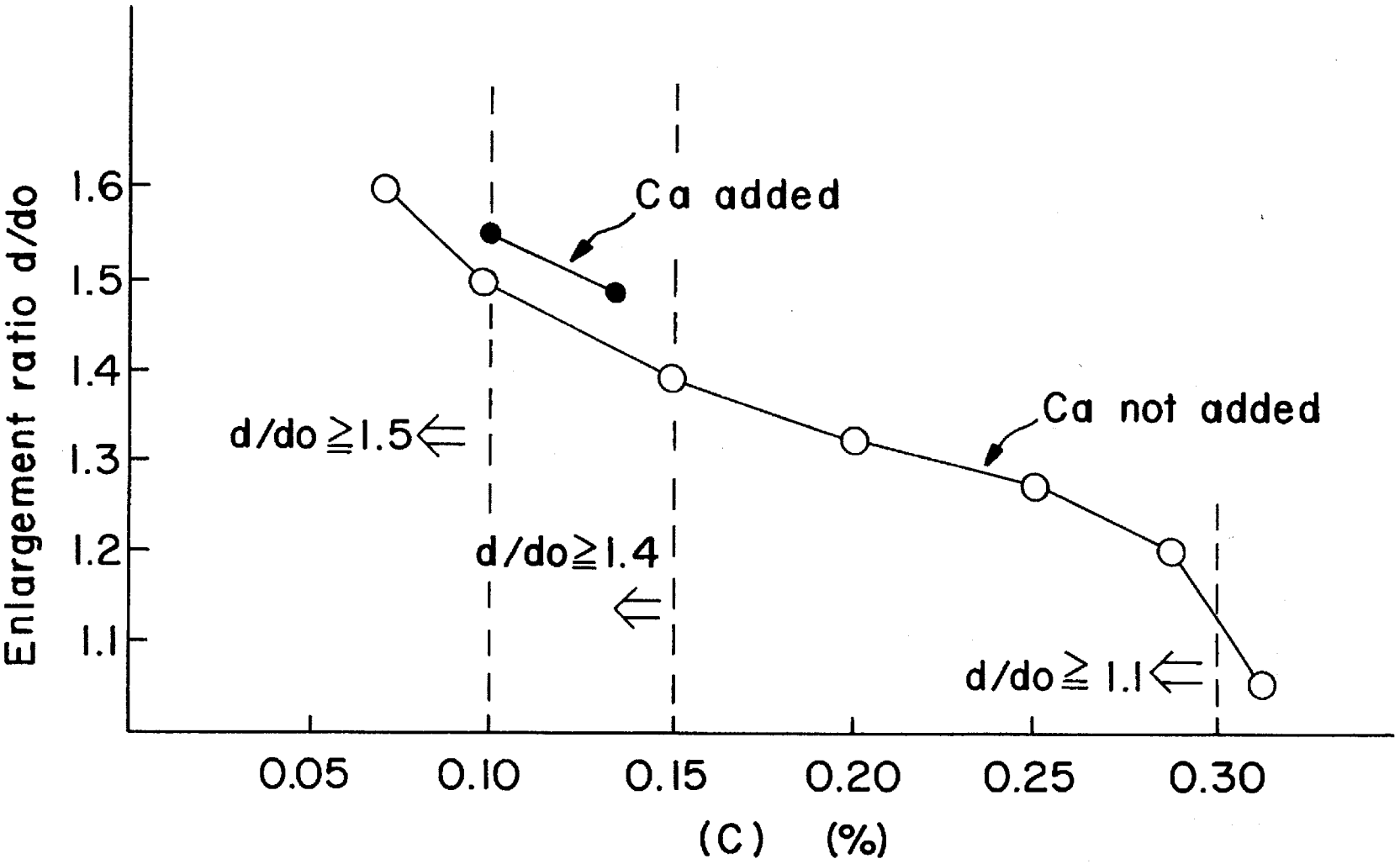
FIG. 5 is a diagram showing conditions for improving an enlargement ratio.

Examples are shown below.

Chemical components other than Fe of steel test pieces are shown in Table 2.

Hot rolled steel sheets according to Examples of the present invention and Comparative Examples are shown in Tables 3 and 4.

TABLE 2

| Steel species | C | Si | Mn | P | S | Al | Ca | REM | Other additive element | Si + Mn |
|---|---|---|---|---|---|---|---|---|---|---|
| A | 0.05 | 1.3 | 1.5 | 0.020 | 0.0002 | 0.021 | — | — | — | 2.8 |
| B | 0.09 | 0.9 | 1.9 | 0.015 | 0.0003 | 0.014 | — | — | — | 2.8 |
| C | 0.09 | 1.6 | 1.7 | 0.018 | 0.0004 | 0.025 | 0.0030 | — | — | 3.3 |
| D | 0.05 | 2.1 | 1.5 | 0.015 | 0.0001 | 0.028 | — | — | — | 3.5 |

TABLE 2-continued

| Steel species | C | Si | Mn | P | S | Al | Ca | REM | Other additive element | Si + Mn |
|---|---|---|---|---|---|---|---|---|---|---|
| E | 0.09 | 2.0 | 1.1 | 0.010 | 0.0002 | 0.030 | — | — | — | 3.1 |
| F | 0.09 | 0.9 | 2.1 | 0.008 | 0.0003 | 0.015 | — | 0.010 | — | 3.0 |
| G | 0.08 | 1.5 | 1.5 | 0.015 | 0.0002 | 0.012 | — | — | Nb = 0.025 | 3.0 |
| H | 0.07 | 1.6 | 1.6 | 0.016 | 0.0002 | 0.024 | — | — | Cr = 0.2 | 3.2 |
| I | 0.06 | 1.7 | 1.5 | 0.020 | 0.0003 | 0.015 | — | — | Ti = 0.02 | 3.2 |
| J | 0.07 | 1.5 | 1.5 | 0.010 | 0.0002 | 0.018 | — | — | B = 0.0005 | 3.0 |
| K | 0.05 | 1.4 | 1.6 | 0.020 | 0.0002 | 0.014 | — | — | V = 0.03 | 3.0 |
| L | 0.08 | 1.8 | 1.4 | 0.015 | 0.0002 | 0.013 | — | — | Mo = 0.2 | 3.2 |
| M | 0.10 | 1.5 | 1.5 | 0.018 | 0.0002 | 0.020 | — | — | — | 3.0 |
| N | 0.14 | 1.0 | 1.3 | 0.015 | 0.0002 | 0.015 | — | — | — | 2.3 |
| O | 0.10 | 2.0 | 1.1 | 0.001 | 0.001 | 0.011 | — | — | — | 3.1 |
| P | 0.14 | 1.3 | 1.3 | 0.009 | 0.003 | 0.024 | — | — | — | 2.6 |
| Q | 0.13 | 1.0 | 2.0 | 0.015 | 0.004 | 0.020 | — | 0.013 | — | 3.0 |
| R | 0.10 | 1.5 | 1.5 | 0.012 | 0.002 | 0.018 | — | — | V = 0.02 | 3.0 |
| S | 0.11 | 1.6 | 1.4 | 0.018 | 0.002 | 0.017 | — | — | B = 0.0004 | 3.0 |
| T | 0.10 | 2.0 | 1.1 | 0.019 | 0.001 | 0.020 | — | — | Ti = 0.01 | 3.1 |
| U | 0.11 | 1.8 | 1.2 | 0.017 | 0.002 | 0.015 | — | — | Cr = 0.1 | 3.0 |
| V | 0.10 | 1.5 | 1.5 | 0.015 | 0.002 | 0.015 | — | — | Nb = 0.015 | 3.0 |
| W | 0.10 | 1.5 | 1.5 | 0.017 | 0.0004 | 0.020 | 0.0040 | — | — | 3.0 |
| X | 0.11 | 1.7 | 1.4 | 0.014 | 0.002 | 0.011 | — | — | Mo = 0.1 | 3.1 |
| Y | 0.05 | 1.3 | 1.5 | 0.018 | 0.0001 | 0.014 | 0.0035 | — | — | 2.8 |
| Z | 0.14 | 1.0 | 1.3 | 0.018 | 0.0003 | 0.017 | 0.0030 | — | — | 2.3 |
| AA | 0.07 | 2.0 | 2.0 | 0.020 | 0.002 | 0.016 | 0.0025 | — | — | 4.0 |
| AB | 0.20 | 1.5 | 1.5 | 0.018 | 0.002 | 0.015 | 0.0030 | — | — | 3.0 |
| AC | 0.13 | 0.3 | 1.2 | 0.017 | 0.0002 | 0.018 | — | — | — | 1.5 |
| AA1 | 0.07 | 3.0 | 3.0 | 0.020 | 0.0002 | 0.015 | 0.0030 | — | — | 6.0 |
| AA2 | 0.28 | 2.8 | 2.8 | 0.010 | 0.0001 | 0.030 | — | — | — | 5.6 |
| AA3 | 0.32 | 2.8 | 2.8 | 0.009 | 0.0001 | 0.010 | — | — | — | 5.6 |

30

TABLE 3

| | | | Microstructure | | | | | | | |
|---|---|---|---|---|---|---|---|---|---|---|
| Distinction | No. | Steel species | $V_F$ (%) | $d_F$ (μm) | $V_F/d_F$ | $\gamma_R$ (%) | $V_B$ (%) | $V_P$ (%) | $V_M$ (%) | Grain size of $\gamma_R$ |
| The invention | 1 | A | 88 | 4.00 | 22.0 | 5 | 7 | 0 | 0 | ≦2 μm |
| The invention | 2 | B | 70 | 3.24 | 21.6 | 5 | 25 | 0 | 0 | ≦2 μm |
| The invention | 3 | C | 84 | 3.59 | 23.4 | 10 | 6 | 0 | 0 | ≦2 μm |
| The invention | 4 | D | 84 | 3.49 | 24.1 | 9 | 7 | 0 | 0 | ≦2 μm |
| The invention | 5 | E | 84 | 3.59 | 23.4 | 10 | 6 | 0 | 0 | ≦2 μm |
| The invention | 6 | F | 73 | 3.33 | 21.9 | 6 | 21 | 0 | 0 | ≦2 μm |
| The invention | 7 | M | 69 | 3.25 | 21.2 | 5 | 26 | 0 | 0 | ≦2 μm |
| The invention | 8 | N | 60 | 2.99 | 20.1 | 5 | 35 | 0 | 0 | ≦2 μm |
| The invention | 9 | O | 78 | 3.45 | 22.6 | 9 | 13 | 0 | 0 | ≦2 μm |
| The invention | 10 | P | 74 | 3.43 | 21.6 | 10 | 16 | 0 | 0 | ≦2 μm |
| The invention | 11 | Q | 78 | 3.45 | 22.6 | 12 | 10 | 0 | 0 | ≦2 μm |
| The invention | 12 | W | 78 | 3.45 | 22.6 | 9 | 13 | 0 | 0 | ≦2 μm |
| The invention | 13 | Y | 80 | 3.42 | 23.4 | 7 | 13 | 0 | 0 | ≦2 μm |
| The invention | 14 | Z | 63 | 3.09 | 20.4 | 6 | 31 | 0 | 0 | ≦2 μm |
| The invention | 15 | AA | 78 | 3.38 | 23.1 | 8 | 14 | 0 | 0 | ≦2 μm |
| The invention | 16 | AB | 56.6 | 2.83 | 20.0 | 5 | 44 | 0 | 0 | ≦2 μm |
| The invention | 17 | AA1 | 75 | 3.00 | 25.0 | 10 | 15 | 0 | 0 | ≦2 μm |
| The invention | 18 | AA2 | 40 | 3.00 | 13.0 | 13 | 43 | 0 | 0 | ≦2 μm |
| Comp. Ex. | 19 | AC | 61 | 2.90 | 21.0 | 0 | 39 | 0 | 0 | — |
| Comp. Ex. | 20 | Z | 80 | 3.76 | 21.3 | 2 | 11 | 7 | 0 | ≦2 μm |
| Comp. Ex. | 21 | B | 79 | 3.46 | 22.8 | 1 | 12 | 0 | 8 | ≦2 μm |
| Comp. Ex. | 22 | Z | 80 | 3.75 | 21.3 | 5 | 15 | 0 | 0 | >2 μm |
| Comp. Ex. | 23 | AA3 | 24 | 3.00 | 8.0 | 13 | 61 | 0 | 0 | ≦2 μm |

TABLE 4

| Distinction | No. | Steel species | Characteristics of steel sheet: TS/YP (kgf/mm²) | YR (%) | T.El/U.El (%) | TS × T.El | $d/d_o$ | Spot weldability | Secondary workability | Toughness | Surface state | Bendability |
|---|---|---|---|---|---|---|---|---|---|---|---|---|
| The invention | 1 | A | 52/41 | 78.8 | 42.5/27.7 | 2210 | 1.71 | ○ | ○ | ○ | ◎ | ○ |
| The invention | 2 | B | 60/46 | 76.7 | 37.2/24.2 | 2230 | 1.55 | ○ | ○ | ○ | ○ | ○ |
| The invention | 3 | C | 67.5/57 | 84.4 | 38.8/25.9 | 2620 | 1.58 | ○ | ○ | ○ | ◎ | ○ |
| The invention | 4 | D | 62.5/54 | 86.4 | 40.5/25.8 | 2530 | 1.68 | ○ | ○ | ○ | ○ | ○ |
| The invention | 5 | E | 64.5/54 | 83.7 | 40.2/27.3 | 2590 | 1.55 | ○ | ○ | ○ | ◎ | ○ |
| The invention | 6 | F | 63/49 | 77.8 | 36.2/23.6 | 2280 | 1.58 | ○ | ○ | ○ | ○ | ○ |
| The invention | 7 | M | 65/49 | 75.4 | 33.8/20.8 | 2200 | 1.50 | ○ | ○ | ○ | ◎ | ○ |
| The invention | 8 | N | 83.5/59 | 70.7 | 26.2/15.4 | 2190 | 1.45 | ○ | ○ | ○ | ◎ | ○ |
| The invention | 9 | O | 66.5/54 | 81.2 | 37.9/25.0 | 2520 | 1.50 | ○ | ○ | ○ | ◎ | ○ |
| The invention | 10 | P | 67/52 | 77.6 | 38.8/27.7 | 2600 | 1.46 | ○ | ○ | ○ | ◎ | ○ |
| The invention | 11 | Q | 71/58 | 81.7 | 38.9/27.8 | 2760 | 1.48 | ○ | ○ | ○ | ◎ | ○ |
| The invention | 12 | W | 65/53 | 81.5 | 38.6/25.9 | 2510 | 1.53 | ○ | ○ | ○ | ◎ | ○ |
| The invention | 13 | Y | 52/44 | 84.6 | 45.4/30.2 | 2360 | 1.73 | ○ | ○ | ○ | ◎ | ○ |
| The invention | 14 | Z | 67/48 | 71.6 | 34.2/23.3 | 2290 | 1.46 | ○ | ○ | ○ | ◎ | ○ |
| The invention | 15 | AA | 74/61 | 82.4 | 32.8/18.9 | 2430 | 1.62 | ○ | ○ | ○ | ◎ | ○ |
| The invention | 16 | AB | 85/68 | 80.0 | 28.0/18.0 | 2380 | 1.34 | Δ | ○ | ○ | ◎ | ○ |
| The invention | 17 | AA1 | 85/60 | 70.5 | 26.0/15.0 | 2210 | 1.42 | ○ | ○ | ○ | ○ | ○ |
| The invention | 18 | AA2 | 110/90 | 81.8 | 22.0/12.0 | 2420 | 1.2 | Δ | ○ | ○ | ○ | ○ |
| Comp. Ex. | 19 | AC | 60/41 | 74.5 | 28.3/14.1 | 1700 | 1.48 | ○ | ○ | ○ | ○ | ○ |
| Comp. Ex. | 20 | Z | 67/50 | 74.6 | 25.4/13.5 | 1700 | 1.38 | ○ | x | x | ◎ | x |
| Comp. Ex. | 21 | B | 80/44 | 55 | 23.8/14.9 | 1900 | 1.22 | ○ | x | x | ◎ | x |
| Comp. Ex. | 22 | Z | 66/49 | 74.2 | 26.5/14.5 | 1749 | 1.29 | ○ | x | x | ◎ | x |
| Comp. Ex. | 23 | AA3 | 123/100 | 81.3 | 20.5/12.0 | 2251 | 1.05 | x | ○ | ○ | ○ | ○ |

Nos. 1 to 18 relate to examples of the present invention, where high yield ratio-type, hot rolled high strength steel sheets excellent in both formability and spot weldability could be obtained. However, No. 16 and No. 18 had a somewhat lower spot weldability due to a higher C content, but had a good workability.

Good surface property was obtained. Particularly good surface property was obtained in Nos. 1, 3, 5, and 7 to 16, because the Si content was in a range of 1.0 to 2.0% by weight.

Nos. 19 to 23 relate to Comparative Examples, where No. 19 had lower Si content and Si+Mn content than the lower limit, and no retained γ was obtained and both strength-ductility balance and uniform elongation were deteriorated; No. 20 contained pearlite and lower retained γ content than 5%, and thus the strength-ductility balance, uniform elongation, enlargeability, bendability, secondary workability and toughness were deteriorated; No. 21 contained martensite and had lower retained γ content than 5%, and the strength-ductility balance, uniform elongation, enlargeability, bendability, secondary workability and toughness were deteriorated, and the yield ratio was lower than 60%; No. 22 maintained 5% of retained γ content, but its grain size was more than 2 μm, and thus the strength-ductility balance, uniform elongation, enlargeability, bendability, secondary workability and toughness were deteriorated; and No. 23 had a higher C content than the upper limit and thus the spot weldability and enlargeability were deteriorated.

Even in the steel species G-L, R-V and X of Table 2, high yield ratio, hot rolled high strength steel sheets excellent in both of formability and spot weldability could be obtained, and their surface states were also better.

Processes for producing hot rolled steel sheets according to examples of the present invention and comparative examples are shown in Table 5 to 10.

TABLE 5

| Distinction | No. | Steel species | Examples of one-stage cooling — Production conditions: Heating temp. °C. | Finish-rolling initiation temp. °C. | Finish-rolling end temp. °C. | Finish-rolling entire draft % | Finish-rolling ultimate pass strain speed/second | Cooling rate °C./sec | Coiling temp. °C. | Cooling after coiling |
|---|---|---|---|---|---|---|---|---|---|---|
| The invention | 24 | C | 1170 | 905 | 800 | 93 | 200 | 40 | 360 | Spontaneous |
| The invention | 25 | C | 1100 | 895 | 790 | 88 | 180 | 35 | 375 | Spontaneous |
| The invention | 26 | C | 1200 | 860 | 800 | 89 | 40 | 45 | 390 | Spontaneous |
| The invention | 27 | C | 1050 | 920 | 850 | 92 | 100 | 50 | 380 | Spontaneous |
| The invention | 28 | C | 1150 | 900 | 810 | 96* | 300 | 50 | 450 | Spontaneous |
| The invention | 29 | C | 1180 | 910 | 800 | 94 | 190 | 75** | 420 | 40° C./hr |
| The invention | 30 | AA1 | 1190 | 920 | 810 | 92 | 70 | 50 | 400 | Spontaneous |
| Comp. Ex. | 31 | C | 1180 | 850 | 740 | 95 | 100 | 45 | 505 | Spontaneous |
| Comp. Ex. | 32 | C | 1170 | 900 | 820 | 93 | 20 | 20 | 380 | Spontaneous |
| Comp. Ex. | 33 | C | 1160 | 905 | 810 | 91 | 150 | 50 | 550 | Spontaneous |
| Comp. Ex. | 34 | C | 1200 | 910 | 800 | 89 | 120 | 45 | 300 | Spontaneous |

TABLE 5-continued

| | | | Examples of one-stage cooling | | | | | | | |
|---|---|---|---|---|---|---|---|---|---|---|
| | | | Production conditions | | | | | | | |
| Distinction | No. | Steel species | Heating temp. °C. | Finish-rolling initiation temp. °C. | Finish-rolling end temp. °C. | Finish-rolling entire draft % | Finish-rolling ultimate pass strain speed/ second | Cooling rate °C./sec | Coiling temp. °C. | Cooling after coiling |
| Comp. Ex. | 35 | C | 1170 | 920 | 860 | 93 | 20 | 60 | 395 | Spontaneous |

*At least 40% for receding four passes
**Quenching right after finish-rolling

TABLE 6

| | | | Examples of one-stage cooling | | | | | | |
|---|---|---|---|---|---|---|---|---|---|
| | | | Microstructure | | | | Steel sheet characterisitcs | | |
| Distinction | No. | Steel species | $V_F$/ $d_F$ ≧ 20 | $\gamma_R$ (grain size: ≦2 μm) ≧ 5% | P | M | TS/YP kgf/mm$^2$ | YR % | T.El/U.El % |
| The invention | 24 | C | ○ | ○ | none | none | 68/57 | 83.8 | 38.6/25.0 |
| The invention | 25 | C | ○ | ○ | none | none | 67.5/56.5 | 83.7 | 39.0/26.0 |
| The invention | 26 | C | ○ | ○ | none | none | 67/56 | 83.6 | 39.2/26.2 |
| The invention | 27 | C | ○ | ○ | none | none | 69/56 | 81.2 | 37/24 |
| The invention | 28 | C | ○ | ○ | none | none | 67.3/57 | 84.7 | 37.5/26.3 |
| The invention | 29 | C | ○ | ○ | none | none | 66.5/56.5 | 85.0 | 39.6/26.7 |
| The invention | 30 | AA1 | ○ | ○ | none | none | 80.2/59.5 | 74.2 | 32.4/20.5 |
| Comp. Ex. | 31 | C | x* | x | yes | none | 65.0/58.0 | 89.2 | 26.1/14.8 |
| Comp. Ex. | 32 | C | ○ | x | yes | none | 65/54 | 83.1 | 27.0/14 |
| Comp. Ex. | 33 | C | ○ | x | yes | none | 63/52 | 82.5 | 27.2/14 |
| Comp. Ex. | 34 | C | ○ | x | none | yes | 80/43 | 51.2 | 24.9/14.9 |
| Comp. Ex. | 35 | C | x | x | none | none | 69.5/48.7 | 70.0 | 26.5/14.5 |

| | | | Steel sheet characteristics | | | | | | |
|---|---|---|---|---|---|---|---|---|---|
| Distinction | No. | Steel species | TS × T.El | $d/d_o$ | Spot weld-ability | Sec. work-ability | Tough-ness | Surface state | Bend-ability |
| The invention | 24 | C | 2625 | 1.57 | ○ | ○ | ○ | ◎ | ○ |
| The invention | 25 | C | 2633 | 1.58 | ○ | ○ | ○ | ◎ | ○ |
| The invention | 26 | C | 2626 | 1.58 | ○ | ○ | ○ | ◎ | ○ |
| The invention | 27 | C | 2553 | 1.56 | ○ | ○ | ○ | ◎ | ○ |
| The invention | 28 | C | 2658 | 1.58 | ○ | ○ | ○ | ◎ | ○ |
| The invention | 29 | C | 2633 | 1.57 | ○ | ○ | ○ | ◎ | ○ |
| The invention | 30 | AA1 | 2598 | 1.48 | ○ | ○ | ○ | ◎ | ○ |
| Comp. Ex. | 31 | C | 1697 | 1.39 | ○ | x | x | ◎ | x |
| Comp. Ex. | 32 | C | 1755 | 1.39 | ○ | x | x | ◎ | x |
| Comp. Ex. | 33 | C | 1714 | 1.39 | ○ | x | x | ◎ | x |
| Comp. Ex. | 34 | C | 1992 | 1.23 | ○ | x | x | ◎ | x |
| Comp. Ex. | 35 | C | 1842 | 1.50 | ○ | x | x | ◎ | ○ |

*Working structure (working α) formed

TABLE 7

| Distinction | No. | Steel species | Heating temp. °C. | Finish-rolling initiation temp. °C. | Finish-rolling end temp. °C. | Finish-rolling entire draft % | Finish-rolling ultimate pass strain speed/sec | Cooling rate $CR_1$ °C./sec | Cooling rate $CR_2$ °C./sec | Cooling rate shift temp. $T_1$ °C. | Coiling temp. °C. | Cooling after coiling |
|---|---|---|---|---|---|---|---|---|---|---|---|---|
| | | | Examples of two-stage cooling | | | | | | | | | |
| | | | Production conditions | | | | | | | | | |
| The invention | 36 | B | 1160 | 915 | 810 | 93 | 150 | 15 | 105 | 760 | 400 | Spontaneous |
| The invention | 37 | B | 1175 | 900 | 820 | 92 | 190 | 5 | 60 | 780 | 385 | Spontaneous |
| The invention | 38 | B | 1150 | 960 | 830 | 94* | 100 | 9 | 50 | 770 | 415 | Spontaneous |
| The invention | 39 | B | 1180 | 940 | 820 | 89 | 180 | 10 | 80 | 760 | 400 | Spontaneous |
| The invention | 40 | B | 1200 | 950 | 830 | 91 | 190 | 12 | 60 | 770 | 380 | 35° C./hr |
| The invention | 41 | AA1 | 1190 | 945 | 830 | 91 | 210 | 12 | 60 | 770 | 390 | Spontaneous |
| Comp. Ex. | 42 | B | 1100 | 800 | 720 | 92 | 150 | 13 | 75 | 680 | 510 | Spontaneous |
| Comp. Ex. | 43 | B | 1190 | 930 | 840 | 77 | 100 | 25 | 80 | 750 | 450 | Spontaneous |
| Comp. Ex. | 44 | B | 1180 | 990 | 870 | 91 | 190 | 40 | 85 | 650 | 440 | Spontaneous |
| Comp. Ex. | 45 | B | 1170 | 950 | 840 | 90 | 120 | 25 | 20 | 700 | 500 | Spontaneous |
| Comp. Ex. | 46 | B | 1160 | 945 | 830 | 93 | 20 | 19 | 90 | 590 | 480 | Spontaneous |
| Comp. Ex. | 47 | B | 1200 | 970 | 860 | 89 | 50 | 10 | 45 | 820 | 400 | Spontaneous |

*At least 40% for preceding four passes

TABLE 8

| Distinction | No. | Steel species | $V_F/d_F \geqq 20$ | $\gamma_R$ (grain size: $\leqq 2$ μm) $\geqq 5\%$ | P | M | TS/YP kgf/mm² | YR % | T.El/U.El % |
|---|---|---|---|---|---|---|---|---|---|
| | | | Examples of two-stage cooling | | | | | | |
| | | | Microstructure | | | | Steel sheet characterisitcs | | |
| The invention | 36 | B | ○ | ○ | none | none | 60/47 | 78.3 | 37.1/24.2 |
| The invention | 37 | B | ○ | ○ | none | none | 59/47 | 79.7 | 38.0/25.0 |
| The invention | 38 | B | ○ | ○ | none | none | 60/46 | 76.7 | 38.5/26 |
| The invention | 39 | B | ○ | ○ | none | none | 60.5/47 | 77.7 | 37.0/24.1 |
| The invention | 40 | B | ○ | ○ | none | none | 60.5/47 | 77.7 | 38.2/25.8 |
| The invention | 41 | AA1 | ○ | ○ | none | none | 81.3/58.2 | 71.6 | 28.4/18.5 |
| Comp. Ex. | 42 | B | x* | x | yes | none | 57/48 | 84.2 | 27.5/14.8 |
| Comp. Ex. | 43 | B | x | x | none | none | 62/43.4 | 70.0 | 28/14 |
| Comp. Ex. | 44 | B | x | x | none | none | 65/56.6 | 70.0 | 27/13 |
| Comp. Ex. | 45 | B | ○ | x | yes | none | 55/45 | 81.8 | 28/14.7 |
| Comp. Ex. | 46 | B | ○ | x | yes | none | 56/45 | 80.4 | 27/14 |
| Comp. Ex. | 47 | B | x | x | none | none | 66/46.2 | 70.0 | 26/13 |

| Distinction | No. | Steel species | TS × T.El | $d/d_o$ | Spot weld-ability | Sec. work-ability | Tough-ness | Surface state | Bend-ability |
|---|---|---|---|---|---|---|---|---|---|
| | | | Steel sheet characteristics | | | | | | |
| The invention | 36 | B | 2226 | 1.55 | ○ | ○ | ○ | ◎ | ○ |
| The invention | 37 | B | 2242 | 1.56 | ○ | ○ | ○ | ○ | ○ |
| The invention | 38 | B | 2310 | 1.56 | ○ | ○ | ○ | ◎ | ○ |
| The invention | 39 | B | 2239 | 1.55 | ○ | ○ | ○ | ○ | ○ |
| The invention | 40 | B | 2311 | 1.55 | ○ | ○ | ○ | ○ | ○ |
| The invention | 41 | AA1 | 2310 | 1.43 | ○ | ○ | ○ | ◎ | ○ |
| Comp. Ex. | 42 | B | 1568 | 1.39 | ○ | x | x | ◎ | x |
| Comp. Ex. | 43 | B | 1736 | 1.50 | ○ | x | x | ○ | ○ |
| Comp. Ex. | 44 | B | 1755 | 1.51 | ○ | x | x | ○ | ○ |
| Comp. Ex. | 45 | B | 1540 | 1.38 | ○ | x | x | ◎ | x |
| Comp. Ex. | 46 | B | 1512 | 1.39 | ○ | x | x | ◎ | x |
| Comp. Ex. | 47 | B | 1716 | 1.52 | ○ | x | x | ○ | ○ |

*Working structure (working α) formed

TABLE 9

| Examples of three-stage cooling | | | | | | | | | | | | | | |
|---|---|---|---|---|---|---|---|---|---|---|---|---|---|---|
| | | | Production conditions | | | | | | | | | | | |
| | | | Heat- | Finish-rolling | Finish-rolling | Finish-rolling | Finish-rolling ultimate | Cooling rate | | | Cooling rate | | | |
| | | | ing | initiation | end | entire | pass strain | $CR_1$ | $CR_2$ | $CR_3$ | shift temp | | Coiling | Cooling |
| Distinction | No. | Steel species | temp. °C. | temp. °C. | temp. °C. | draft % | speed/ sec | °C./ sec | °C./ sec | °C./ sec | $T_1$ °C. | $T_2$ °C. | temp. °C. | after coiling |
| The invention | 48 | AA | 1170 | 900 | 800 | 94* | 100 | 50 | 5 | 50 | 750 | 725 | 380 | 40° C./hr |
| The invention | 49 | AA | 1190 | 970 | 850 | 93 | 50 | 90 | 15 | 90 | 700 | 600 | 410 | Spontaneous |
| The invention | 50 | C | 1200 | 930 | 820 | 92 | 80 | 40 | 7 | 40 | 700 | 680 | 405 | Spontaneous |
| The invention | 51 | C | 1180 | 960 | 870 | 91 | 190 | 85 | 18 | 85 | 710 | 610 | 390 | Spontaneous |
| The invention | 52 | C | 1190 | 970 | 860 | 92 | 210 | 95 | 8 | 100 | 650 | 600 | 390 | Spontaneous |
| The invention | 53 | AA1 | 1185 | 960 | 840 | 93 | 150 | 90 | 15 | 90 | 700 | 600 | 410 | Spontaneous |
| Comp. Ex. | 54 | C | 1200 | 980 | 865 | 94 | 200 | 60 | 35 | 60 | 670 | 600 | 440 | Spontaneous |
| Comp. Ex. | 55 | C | 1160 | 980 | 870 | 93 | 170 | 80 | 9 | 20 | 660 | 600 | 480 | Spontaneous |
| Comp. Ex. | 56 | C | 1200 | 990 | 880 | 92 | 180 | 40 | 7 | 60 | 840 | 805 | 430 | Spontaneous |
| Comp. Ex. | 57 | C | 1180 | 970 | 870 | 82 | 25 | 25 | 15 | 85 | 710 | 620 | 400 | Spontaneous |

*At least 40% for preceding four passes

TABLE 10

| Examples of three-stage cooling | | | | | | | | | |
|---|---|---|---|---|---|---|---|---|---|
| | | | Microstructure | | | | | | |
| | | | $V_F$/ | $\gamma_R$ (grain size: | | | Steel sheet characterisitcs | | |
| Distinction | No. | Steel species | $d_F$ ≧ 20 | ≦2 μm) ≧ 5% | P | M | TS/YP kgf/mm² | YR % | T.El/U.El % |
| The invention | 48 | AA | ○ | ○ | none | none | 74.2/61 | 82.2 | 34.8/21.8 |
| The invention | 49 | AA | ○ | ○ | none | none | 73/60.5 | 82.9 | 34.5/24.5 |
| The invention | 50 | C | ○ | ○ | none | none | 67/57 | 85.1 | 39/26 |
| The invention | 51 | C | ○ | ○ | none | none | 68/58 | 85.3 | 37/24 |
| The invention | 52 | C | ○ | ○ | none | none | 67/56 | 83.6 | 38/25 |
| The invention | 53 | AA1 | ○ | ○ | none | none | 85/61 | 71.8 | 26.2/15.1 |
| Comp. Ex. | 54 | C | x | x | none | none | 71/49.7 | 70.0 | 25/12 |
| Comp. Ex. | 55 | C | ○ | x | yes | none | 64/53 | 82.8 | 27/14 |
| Comp. Ex. | 56 | C | x | x | none | none | 70/49 | 70.0 | 26/13 |
| Comp. Ex. | 57 | C | x | x | none | none | 66/55 | 83.3 | 27/13 |

| | | | Steel sheet characteristics | | | | | | |
|---|---|---|---|---|---|---|---|---|---|
| Distinction | No. | Steel species | TS × T.El | $d/d_o$ | Spot weld-ability | Sec. work-ability | Tough-ness | Surface state | Bend-ability |
| The invention | 48 | AA | 2582 | 1.63 | ○ | ○ | ○ | ◎ | ○ |
| The invention | 49 | AA | 2519 | 1.64 | ○ | ○ | ○ | ◎ | ○ |
| The invention | 50 | C | 2613 | 1.58 | ○ | ○ | ○ | ◎ | ○ |
| The invention | 51 | C | 2516 | 1.59 | ○ | ○ | ○ | ◎ | ○ |
| The invention | 52 | C | 2546 | 1.59 | ○ | ○ | ○ | ◎ | ○ |
| The invention | 53 | AA1 | 2227 | 1.43 | ○ | ○ | ○ | ◎ | ○ |
| Comp. Ex. | 54 | C | 1775 | 1.58 | ○ | x | x | ◎ | ○ |
| Comp. Ex. | 55 | C | 1728 | 1.39 | ○ | x | x | ◎ | x |
| Comp. Ex. | 56 | C | 1820 | 1.59 | ○ | x | x | ◎ | ○ |
| Comp. Ex. | 57 | C | 1792 | 1.50 | ○ | x | x | ◎ | ○ |

Figure 6:
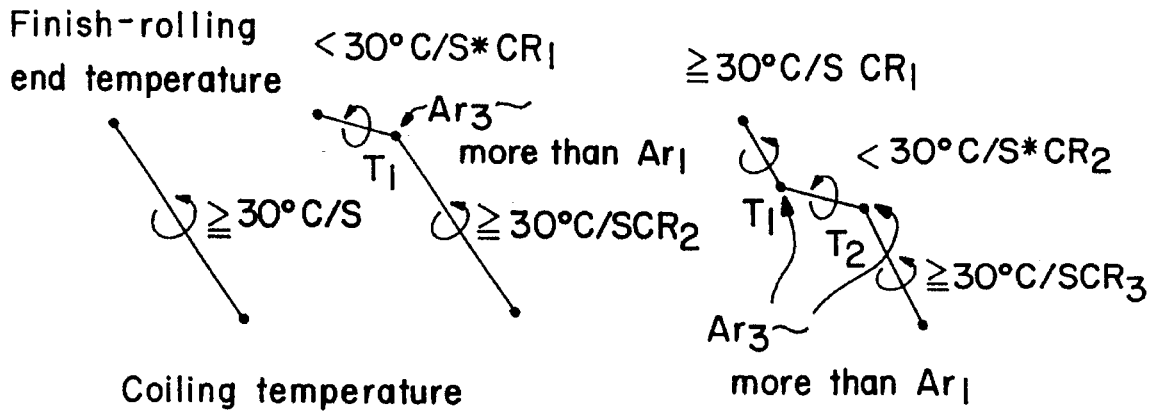
FIG. 6 is a diagram showing cooling steps at a cooling table.

Tables 5 and 6 show processes for producing a hot rolled steel sheet in case of one-stage cooling at the cooling table according to the present examples and comparative examples, shown in FIG. 6.

Nos. 24 to 30 relate to examples of the present invention, where high yield ratio-type, hot rolled high strength steel sheets excellent in both formarbility and spot weldability could be obtained and their surface states were found to be better.

Nos. 31 to 35 relate to comparative examples, where No. 31 had a lower rolling end temperature than the lower limit and a higher coiling temperature than the upper limit, and thus a working structure (working α) and pearlite were formed, and not less than 5% by weight of retained γ having grain sizes of not more than 2 μm could not be obtained, and, as a result, the strength-ductility balance, uniform elongation, enlargeability, bendability, secondary workability and toughness were deteriorated; No. 32 had a lower finish-rolling ultimate pass strain speed than the lower limit and a lower cooling rate than the lower limit, resulting in formation of pearlite, and not less than 5% of retained γ having grain sizes of not more than 2 μm could not be obtained, and, as a result, the strength-ductility balance, uniform elongation, enlargeability, bendability, secondary workability and toughness were deteriorated; No. 33 had a higher coiling temperature than the upper limit, resulting in formation of pearlite, and not less than 5% of retained γ having grain sizes of not more than 2 μm could not be obtained, and, as a result, the strength-ductility balance, uniform elongation, enlargeability, bendability, secondary workability and toughness were deteriorated; No. 34 had a lower coiling temperature than the lower limit, resulting in formation of martensite, and not less than 5% of retained γ having grain sizes of not more than 2 μm could not be obtained, and, as a result, the strength-ductility balance, uniform elongation, enlargeability, bendability, secondary workability and toughness were deteriorated, and the yield ratio was lower than 60%; and No. 35 had a higher finish-rolling end temperature than the upper limit and a lower finish-rolling ultimate pass strain speed than the lower limit, resulting in failure to attain such a relationship as $V_F/d_F \geqq 20$, and not less than 5% of retained γ having grain sizes of not more than 2 μm could not be obtained, and, as a result, the strength-ductility balance, uniform elongation, secondary workability and toughness were deteriorated.

Tables 7 and 8 show processes for producing hot rolled steel sheets in case of two-stage cooling at the cooling table according to the present examples and comparative examples, as shown in FIG. 6.

Nos. 36 to 41 relate to examples of the present invention, where high yield ratio-type, hot rolled high strength steel sheets excellent in both formability and spot weldability could be obtained and their surface states were found to be better.

Nos. 42 to 47 relate to comparative examples, where No. 42 had a lower finish-rolling end temperature than the lower limit and a higher coiling temperature than the upper limit, resulting in formation of working structure (working α) and pearlite, and not less than 5% of retained γ having grain sizes of not more than 2 μm could not be obtained, and, as a result, the strength-ductility balance, uniform elongation, enlargeability, bendability, secondary workability and toughness were deteriorated; No. 43 had a lower entire draft of finish-rolling than the lower limit, resulting in failure to attain such a relation as $V_F/d_F > 20$, and not more than 5% of retained γ having grain sizes of not less than 2 μm could not be obtained, and, as a result, the strength-ductility balance, uniform elongation, secondary workability and toughness were deteriorated; No. 44 had a higher cooling rate at the first stage than the upper limit, resulting in failure to attain such a relation as $V_F/d_F \geqq 20$, and not less than 5% of retained γ having grain sizes of not more than 2 μm could not be obtained, and, as a result, the strength-ductility balance, uniform elongation, secondary workability and toughness were deteriorated; No. 45 had a lower cooling rate at the second stage than the lower limit, resulting in formation of pearlite, and not more than 5% of retained γ having grain sizes of not more than 2 μm could not be obtained, and, as a result, the strength-ductility balance, uniform elongation, enlargeability, bendability, secondary workability and toughness were deteriorated; No. 46 had a lower finish-rolling ultimate pass strain speed than the lower limit and a higher coiling temperature than the upper limit, resulting in formation of pearlite, and not less than 5% of retained γ having grain sizes of not more than 2 μm could not be obtained, and, as a result, the strength-ductility balance, uniform elongation, enlargeability, bendability, secondary workability and toughness were deteriorated; and No. 47 had a higher cooling end temperature (cooling rate shift temperature $T_1$) at the first stage than the upper limit, resulting in failure to attain such a relation as $V_F/d_F > 20$ and not less than 5% of retained γ having grain size of not more than 2 μm could not be obtained, and, as a result, the strength-ductility balance, uniform elongation, secondary workability and toughness were deteriorated.

Tables 9 and 10 show processes for producing hot rolled steel sheets in case of three-stage cooling at the cooling table according to the present examples and comparative examples, shown in FIG. 6.

Nos. 48 to 53 relate to examples of the present invention, where high yield ratio-type, hot rolled high strength steel sheets excellent in both formability and spot weldability could be obtained and their surface states were found to be better.

Nos. 54 to 56 relate to comparative examples, where No. 54 had a higher cooling rate at the second stage than the upper limit, resulting in failure to attain such a relation as $V_F/d_F \geqq 20$ and not less than 5% of retained γ having grain sizes of not more than 2 μm could not be obtained, and, as a result, the strength-ductility balance, uniform elongation, secondary workability and toughness were deteriorated; No. 55 had a lower cooling rate at the third stage than the lower limit, resulting in the formation of pearlite, and not less than 5% of retained γ having grain sizes of not more than 2 μm could not be obtained, and, as a result, the strength-ductility balance, uniform elongation, enlargeability, bendability, secondary workability and toughness were deteriorated; No. 56 had higher cooling end temperatures (cooling rate shift temperatures $T_1$ and $T_2$) at the first and second stages, respectively, than the upper limits, resulting in failure to attain such a relationship as $V_F/d_F \geqq 20$, and not less than 5% of retained γ having grain sizes of not more than 2 μm could not be obtained, and, as a result, the strength-ductility balance, uniform elongation, secondary workability and toughness were deteriorated; No. 57 had a lower finish-rolling ultimate strain speed than the lower limit, resulting in failure to attain such a relation as $V_F/d_F \geqq 20$, and not more than 5% of retained γ having grain sizes of not less than 2 μm could not be obtained, and, as a result, the strength-ductility balance, uniform elongation, secondary workability and toughness were deteriorated.

Even in the steel species G-L, R-V and X of Table 2, high yield ratio-type, hot rolled high strength steel sheets having excellent formability and spot weldability together and a good surface state could be obtained according to the same processes of the present invention.

As is apparent from the foregoing, various practical cases and parts can be made available only according to the present invention with combined characteristics.

Evaluation of the characteristics has been made according to the following procedures:

Tensile tests were carried out according to JIS No. 5 to determine tensile strength (TS), yield strength (YP), yield ratio (YR=100×YP/TS), total elongation (T.E1), uniform elongation (U.E1), and strength-ductility balance (TS×T.E 1).

Enlargeability or hole expansibility was expressed by an enlargement ratio ($d/d_o$), determined by enlarging a punch hole, 20 mm in diameter (initial diameter:$d_o$), with a 30° cone punch from the flash-free side to measure a hole diameter (d) when a crack passed through the test piece in the thickness direction, and obtaining the ratio ($d/d_o$).

Bendability was determined by bending a test piece, 35 mm× 70 mm, at a 90° V bending angle with 0.5 R at the tip end (bending axis being in the rolling direction), while making the flash existing side outside, and non-occurrence of cracks, 1 mm or longer, was expressed by a round mark "◎", and the occurrence of such cracks by a crossed mark "X".

Secondary workability was determined by crushing a cup which was shaped from a punched plate (punch hole: 90 mm in diameter) at a drawing ratio of 1.8, at −50° C. and non-occurrence of cracks was expressed by a round mark "◎" and the occurrence of cracks by a corssed mark "X".

Toughness was expressed by a round mark "◎" when the test piece was satisfactory at a transition temperature of −120° C. or less, and by a crossed mark "X" when not.

Spot weldability was determined by dividing a spot-welding test piece into two orignial pieces by a chisel and non-occurrence of breakage inside the nugget (portion melted at the spot welding and solidified thereafter) was expressed by a round mark "◎" and the occurrence thereof by a crossed mark "X".

Surface state was visually inspected, and a very good surface state was expressed by a double round mark "◎" and a good surface state by a round mark "◎".

Industrial Applicability

In the present invention, a hot rolled high strength steel sheet having combined characteristics not found in the prior art, that is, a hot rolled high strength steel sheet having an excellent formability, a high yield ratio and an excellent spot weldability, can be stably produced at a low cost, and applications and service conditions can be considerably expanded.

We claim:

1. A process for producing a high yield ratio-type, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, which comprises conducting a finish-rolling of a slab prepared by casting a steel consisting essentially of 0.05 to less than 0.15% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, and a volume fraction of retained austenite having a grain size of not more than 2 μm being not less than 5%, at an end temperature range of $Ar_3$±50° C. at an entire draft of not less than 80% and an ultimate pass strain speed of not less than 30/second, conducting cooling at a hot run table at a rate of not less than 30° C./second, and conducting coiling at a temperature of more than 350° C. to 500° C.

2. A process for producing a high yield ratio, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, which comprises conducting a finish-rolling of a slab prepared by casting a steel consisting essentially of 0.05 to less than 0.15% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, and a volume fraction of retained austenite having a grain size of not more than 2 μm being not less than 5%, at an end temperature range of $Ar_3$±50° C., at an entire draft of not less than 80% and an ultimate pass strain speed of not less than 30/second, conducting cooling at a hot run table at a rate of not less than 30° C./second, and conducting coiling at a temperature of more than 350° C. to 500° C.

3. A process for producing a high yield ratio, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, which comprises conducting a finish-rolling of a slab prepared by casting a steel consisting essentially of 0.05 to less than 0.15% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, and a volume fraction of retained austenite having a grain size of not more than 2 μm being not less than 5%, at an end temperature of not less than $Ar_3$−50° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of less than 30° C./second, and from $T_1$ downwards at a rate of not less than 30° C./second, and conducting coiling at a temperature of more than 350° C. to 500° C.

4. A process for producing a high yield ratio, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, which comprises conducting a finish-rolling of a slab prepared by casting a steel consisting essentially of 0.05 to less than 0.15% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, and a volume fraction of retained austenite having a grain size of not more than 2 μm being not less than 5%, at an end temperature of not less than $Ar_3$–50° C. at an entire draft of not less than 80% and an ultimate pass strain speed of not less than 30/second, conducting cooling at a hot run table down to a temperature $T_1$ in a range of not more than $Ar_3$ to more than $Ar_1$, at a rate of less than 30° C./second, and from $T_1$ downwards at a rate of not less than 30° C./second, and conducting coiling at a temperature of more than 350° C. to 500 ° C.

5. A process for producing a high yield ratio, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, which comprises conducting a finish-rolling of a slab prepared by casting a steel consisting essentially of 0.05 to less than 0.15% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, the balance consisting essentially of Fe, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, and a volume fraction of retained austenite having a grain size of not more than 2 μm being not less than 5%, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of not less than 30° C./second, and from $T_1$ downwards to a temperature $T_2$ in a range of not more than $T_1$ to more than $Ar_1$ at a rate of less than 30° C./second, and furthermore from $T_2$ downwards at a rate of not less than 30° C./second, and conducting coiling at a temperature of more than 350° C. to 500 ° C.

6. A process for producing a high yield ratio, hot rolled high strength steel sheet having both an excellent formability and spot weldability, and also having a yield ratio (YR) of not less than 60%, a strength-ductility balance (tensile strength×total elongation) of not less than 2,000 (kgf/mm$^2$.%), an enlargement ratio ($d/d_o$) of not less than 1.4 and a uniform elongation of not less than 15%, which comprises conducting a finish-rolling of a slab prepared by casting a steel consisting essentially of 0.05 to less than 0.15% by weight of C, 0.5 to 3.0% by weight of Si, 0.5 to 3.0% by weight of Mn, more than 1.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 20, and a volume fraction of retained austenite having a grain size of not more than 2 μm being not less than 5%, at an end temperature of not less than $Ar_3$–50° C. at an entire draft of not less than 80% and an ultimate pass strain speed of not less than 30/second, conducting cooling at a hot run table down to a temperature $T_1$ in a range of not more than $Ar_3$ to more than $Ar_1$ at a rate of not less than 30° C./second, and from $T_1$ downwards to a temperature $T_2$ in a range of not more than $T_1$ to more than $Ar_1$ at a rate of less than 30° C./second, and furthermore from $T_2$ downwards at a rate of not less than 30° C./second, and conducting coiling at a temperature of more than 350° C. to 500° C.

7. A process for producing a high yield ratio, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, which comprises conducting a finish-rolling of a slab prepared by casting a steel consisting essentially of 0.15 to less than 0.30% by weight of C, 2.0 to 3.0% by weight of Si, 0.5 to 3.0% by weight of Mn, more than 2.5 to 6.0% by weight of Si and Mn in total, not more than 0.02% by weight of P, not more than 0.01% by weight of S, and 0.005 to 0.10% by weight of Al, the balance consisting essentially of Fe, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 7, and a volume fraction of retained austenite having a grain size of not more than 2 μm being not less than 5%, at an end temperature range of $Ar_3$±50° C. at an entire draft of not less than 80% and an ultimate pass strain speed of not less than 30/second, conducting cooling at a hot run table at a rate of not less than 30° C./second, and conducting coiling at a temperature of more than 350° C. to 500° C.

8. A process for producing a high yield ratio, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, which comprises conducting a finish-rolling of a slab prepared by casting a steel consisting essentially of 0.15 to less than 0.30% by weight of C, 2.0 to 3.0% by weight of Si, 0.5 to 3.0% by weight of Mn, more than 2.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 7, and a volume fraction of retained austenite having a grain size of not more than 2 μm being not less than 5%, at an end temperature range of $Ar_3$±50° C. at an entire draft of not less than 80% and an ultimate pass strain speed of not less than 30/second, conducting cooling at a hot run table at a rate of not less than 30° C./second, and conducting coiling at a temperature of more than 350° C. to 500° C.

9. A process for producing a high yield ratio, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, which comprises conducting a finish-rolling of a slab prepared by casting a steel consisting essentially of 0.15 to less than 0.30% by weight of C, 2.0 to 3.0% by weight of Si, 0.5 to 3.0% by weight of Mn, more than 2.5 to 6.0% by weight of Si and Mn in total, not more than 0.02% by weight of P, not more than 0.01% by weight of S, and 0.005 to 0.10% by weight of Al, the balance consisting essentially of Fe, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 7, and a volume fraction of retained austenite having a grain size of not more than 2 μm being not less than 5%, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of less than 30° C./second, and from $T_1$ downwards at a rate of not less than 30° C./second, and conducting coiling at a temperature of more than 350° C. to 500° C.

10. A process for producing a high yield ratio, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, which comprises conducting a finish-rolling of a slab prepared by casting a steel consisting essentially of 0.15 to less than 0.30% by weight of C, 2.0 to 3.0% by weight of Si, 0.5 to 3.0% by weight of Mn, more than 2.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 7, and a volume fraction of retained austenite having a grain size of not more than 2 μm being not less than 5%, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$, at a rate of less than 30° C./second and from $T_1$ downwards at a rate of not less than 30° C./second, and conducting coiling at a temperature of more than 350° C. to 500° C.

11. A process for producing a high yield ratio, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, which comprises conducting a finish-rolling of a slab prepared by casting a steel consisting essentially of 0.15 to less than 0.30% by weight of C, 2.0 to 3.0% by weight of Si, 0.5 to 3.0% by weight of Mn, more than 2.5 to 6.0% by weight of Si and Mn in total, not more than 0.02% by weight of P, not more than 0.01% by weight of S, and 0.005 to 0.10% by weight of Al, the balance consisting essentially of Fe, being composed of three phases of ferrite, bainite and retained austenite as microstructure and having a ferrite grain size ($d_F$) of not more than 5 μm, a ratio ($V_F/d_F$) of ferrite volume fraction ($V_F$) to ferrite grain size ($d_F$) of not less than 7, and a volume fraction of retained austenite having a grain size of not more than 2 μm being not less than 5%, at an end temperature of not less than $Ar_3$–50° C., at an entire draft of not less than 80% and an ultimate pass strain speed of not less than 30/second, conducting cooling at a hot run table down to a temperature $T_1$ in a range of not more than $Ar_3$ to more than $Ar_1$ at a rate of not less than 30° C./second, from $T_1$ downwards to a temperature $T_2$ in a range of not more than $T_1$ to more than $Ar_1$ at a rate of less than 30° C./second, and furthermore from $T_2$ downwards at a rate of not less than 30° C./second, and conducting coiling at a temperature of more than 350° C. to 500° C.

12. A process for producing a high yield ratio, hot rolled high strength steel sheet having an excellent formability and also a yield ratio (YR) of not less than 60%, a strength-ductility balance (tensile strength×total elongation) of not less than 2,000 (kgf/mm$^2$.%), an enlargement ratio ($d/d_o$) of not less than 1.1, and a uniform elongation of not less than 10%, which comprises conducting a finish-rolling of a slab prepared by casting a steel consisting essentially of 0.15 to less than 0.30% by weight of C, 2.0 to 3.0% by weight of Si, 0.5 to 3.0% by weight of Mn, more than 2.5 to 6.0% by weight of Si and Mn in total, not more than 0.02% by weight of P, not more than 0.01% by weight of S, and 0.005 to 0.10% by weight of Al, and 0.0005 to 0.01% by weight of Ca or 0.005 to 0.05% by weight of REM, the balance being Fe and inevitable elements, being composed of three phases of ferrite, bainite and retained austenite as microstructure, and having a ferrite grain size ($d_F$) of not more than 5 μm, a ratio ($V_F/d_F$) of ferrite volume fraction ($V_F$) to ferrite grain size ($d_F$) of not less than 7, and a volume fraction of retained austenite having a grain size of not more than 2 μm being not less than 5%, at an end temperature of not less than $Ar_3$–50° C. at an entire draft of not less than 80%, and an ultimate pass strain speed of not less than 30/second, conducting cooling at a hot run table down to a temperature $T_1$ in a range of not more than $Ar_3$ to more than $Ar_1$ at a rate of not less than 30° C./second, from $T_1$ downwards to a temperature $T_2$ in a range of not more than $T_1$ to more than $Ar_1$ at a rate of less than 30° C./second, and furthermore from $T_2$ downwards at a rate of not less than 30° C./second, and conducting coiling at a temperature of more than 350° C. to 500° C.

13. A process for producing a high yield ratio, hot rolled high strength steel sheet excellent in both formability and spot weldability according to any one of claims (1) to (6), wherein the hot finish-rolling initiation temperature of the steel is not more than $Ar_3$+ 100° C.

14. A process for producing a high yield ratio, hot rolled high strength steel sheet excellent in both formability and spot weldability according to any one of claims (1) to (6), wherein after the coiling the steel sheet is cooled to 200° C. or less at a cooling speed of not less than 30° C./hour.

15. A process for producing a high yield ratio, hot rolled high strength steel sheet excellent in formability according to any one of claims (7) to (12), wherein the hot finish-rolling initiation temperature of the steel is not more than $Ar_3$+100° C.

16. A process for producing a high yield ratio, hot rolled high strength steel sheet excellent in formability according to any one of claims (7) to (12), wherein after the coiling the steel sheet is cooled to 200° C. or less at a cooling speed of not less than 30° C./hour.

* * * * *